United States Patent [19]

Karls

[11] Patent Number: 4,589,851

[45] Date of Patent: May 20, 1986

[54] FLUSHING DEVICE FOR OUTBOARD MOTORS

[75] Inventor: Michael A. Karls, Hilbert, Wis.

[73] Assignee: Brunswick Corporation, Skokie, Ill.

[21] Appl. No.: 732,113

[22] Filed: May 9, 1985

[51] Int. Cl.[4] ..... B08B 9/00

[52] U.S. Cl. ..... 440/88; 440/900; 134/167 R; 134/169 A

[58] Field of Search ..... 440/113, 900, 88; 285/325, 364; 134/167 R, 169 A, 199

[56] References Cited

U.S. PATENT DOCUMENTS 540,689 6/1895 Reams ..... 285/325

3,002,488 10/1961 Guhlin ..... 440/113

3,217,696 11/1965 Kiekhaefer ..... 440/900

4,359,063 11/1982 Carlson ..... 440/900

*Primary Examiner*—Trygve M. Blix

*Assistant Examiner*—Edwin L. Swinehart

*Attorney, Agent, or Firm*—O. T. Sessions

[57] ABSTRACT

A flushing device (12) is provided to supply water to an inlet (18) provided on the bottom of the anti-ventilation plate (14) of an outboard motor. The flushing device (12) uses a mounting bracket (22) to hold a resilient cup (20) compressed in place over the water inlet (18). A hose connector (24) allows the cup (20) to be connected to a water supply.

5 Claims, 2 Drawing Figures

FLUSHING DEVICE FOR OUTBOARD MOTORS

TECHNICAL FIELD

This invention relates to flushing devices for marine propulsion units and particularly to a device capable of being clamped to an outboard propulsion unit when the unit is out of the water to supply water to the water inlet.

BACKGROUND ART

Flushing devices are used to supply water to the water intake port or ports of outboard motors and stern drives to clean the internal passages of the motors or to provide coolant allowing the motors to be run while they are out of the water. U.S. Pat. No. 3,931,828 to Lawler and U.S. Pat. No. 4,359,063 to Carlson show flushing devices which are mechanically clamped to the gearcase of an outboard motor to provide water to water inlets formed in the sides of the gearcase. U.S. Pat. No. 3,002,488 to Guhlin shows a flushing device clamped to the outboard motor to provide water to an inlet formed on the bottom of the anti-ventilation plate.

DISCLOSURE OF INVENTION

One of the objects of this invention is to provide a flushing device which can be used on outboard motors having a water inlet formed on the bottom of the anti-ventilation plate. Another object of the invention is to provide a flushing device which may be easily and quickly attached to an outboard motor. Yet another object of this invention is to provide a flushing device which necessitates the removal of the propeller before the flushing device can be attached.

The present invention provides a flushing device for supplying water to the cooling water inlets located on the bottom of a generally horizontal planar element fixed above the propeller shaft of an outboard motor. The flushing device includes a resilient sealing element for covering the cooling water inlet and a water passage through the sealing element for supplying water to the water inlet. A mounting bracket is attached to the sealing element to hold the sealing element compressed against the bottom surface of the planar element to cover the cooling water inlet. Two projections from the mounting bracket engage the opposite sides of the planar element on its upper surface.

The mounting bracket may readily be formed from a strip of sheet metal with the projections engaging the planar portion of the outboard motor formed by the opposite ends of the strip of sheet metal. The resilient sealing elements can be generally cup shaped and include a cylindrical portion extending through a hole in the mounting bracket for attaching the mounting bracket. Preferably a water passage is provided through the cylindrical portion of the sealing cups.

BEST MODE FOR CARRYING OUT THE INVENTION

Figure 1:
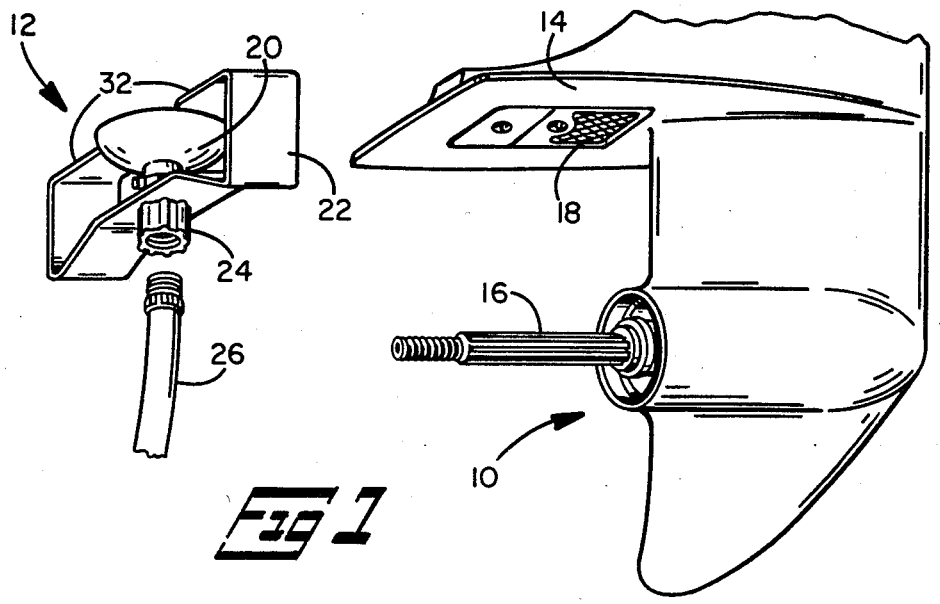
FIG. 1 is a perspective view of a flushing device according to the invention showing the device adjacent the outboard motor on which it is to be attached.

Turning now to FIG. 1, the lower unit 10 of a typical outboard motor is shown alongside the flushing device

12 of the invention. The lower unit 10 of the outboard motor has a generally horizontal planar anti-ventilation plte 14 which, in operation, is normally positioned at or slightly under the surface of the water in which the outboard motor is operating. A propeller shaft 16, driven by an engine, not illustrated, is positioned under the anti-ventilation plate 14 to carry a propeller, not illustrated, for driving the outboard motor through the water. The engine is cooled by water taken in through a water inlet 18 provided on the lower side of the anti-ventilation plate 14.

The flushing device 12 of the invention provides a means to supply water to the water inlet 18 of the outboard propulsion unit when the propulsion unit is removed from the water in which it normally operates. It is desirable to be able to operate the outboard motor out of the water for purposes of cleaning the water passages through the outboard motor or for maintenance purposes.

The flushing device 12 of the invention includes a resilient sealing element 20 for covering the cooling water inlet 18 of the outboard propulsion unit and a mounting bracket 22 attached to the resilient sealing element 20 for holding the sealing element 20 in position over the water inlet 18. A connection 24 for connecting the sealing element 20 to an external water supply such as hose 26 is provided.

Figure 2:
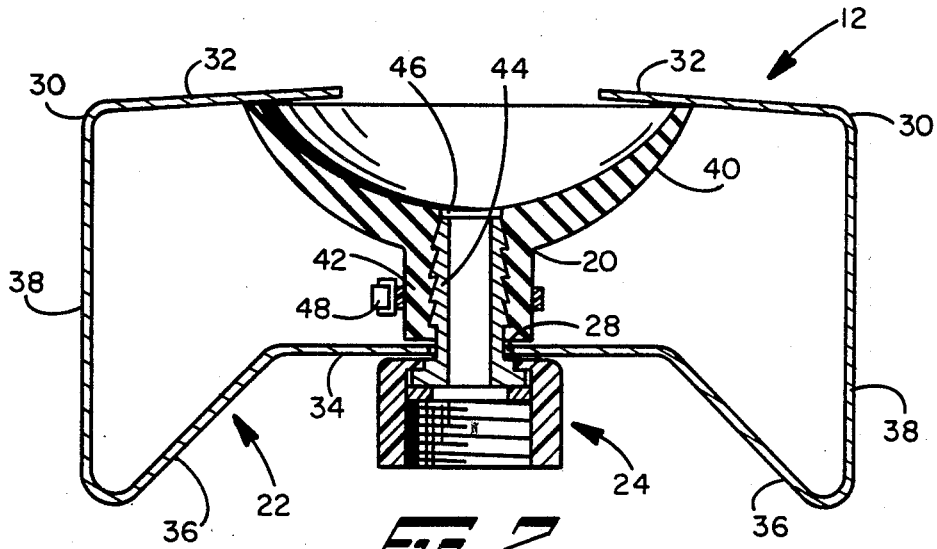
FIG. 2 is a cross-sectional view of the flushing device of the invention.

The mounting bracket 22 is formed from a strip of sheet metal, 1/16 inch thick. An aluminum alloy such as 6061 Aluminum has been found to be a satisfactory material for the bracket 22. A hole 28 is provided through the center of the strip for attaching the resilient sealing cup 20. The ends and edges of the strip are rounded to avoid sharp edges and corners which could mar the surface of the outboard propulsion unit. As most clearly shown in FIG. 2, the sheet metal strip forming the mounting bracket 22 has two sharp bends 30 near each end of the strip to provide projections 32 for engaging the upper surface of the planar anti-ventilation plate 14. The central portion 34 of this strip is generally straight to provide a suitable surface for attaching the sealing element 20. From the central straight portion 34 of this strip, projections 36 are formed downward away from the anti-ventilation plate 14. These downward projections 36 are intended to project into the region normally occupied by the propeller mounted on the propeller shaft 16 of the outboard propulsion unit. The strip is then bent upward from each of the downward projections to provide segments 38 extending upward to engage the anti-ventilation plate 14. A strip approximately two inches wide has been found to provide sufficient strength for the mounting bracket 22.

The sealing device 20 is generally cup shaped and is molded of a strong resilient synthetic elastomer. The cup 40 is relatively thick in the center and tapered toward the outer rim. The construction of the cup 40 allows it to be compressed against the lower portion of the anti-ventilation plate 14 over the water inlet while providing a force back against the support bracket 22. A central cylindrical body 42 is formed on the outside of the cup 40 to provide an attachment point for the supporting bracket 22 and for a hose connection 24.

The resilient sealing cup 20 is held on the mounting bracket 22 by a standard female water hose connector 24. The tubular portion 44 of the hose connector 24 is inserted through the hole 28 in the support bracket 22 and into the water passage 46 formed through the central cylindrical portion 42 of the sealing cup 20. A hose clamp 48 secured around the cylindrical portion 42 of the sealing cup 20 completes the attachment of the hose connector 24 to the sealing cup 20.

To use the flushing device 12 of the invention, the operator would first grasp the flushing device 12 in a manner to pull the rim of the resilient cup 20 downward. The flushing device 12 may then be slid onto the anti-ventilation plate 14 of the outboard propulsion unit with the projections 32 on top of the anti-ventilation plate 14 until the resilient cup 20 is positioned over the water inlet 18. A hose 26 may then be attached to the hose connector 24 and water turned on to supply water to the water inlet 18. The engine may then be run to clear this system of any accumulated debris within the water system.

I claim:

1. A flushing device for supplying water to a cooling water inlet opening in the bottom surface of a generally horizontal planar element fixed above the propeller shaft of an outboard motor, said device comprising:

(A) a generally cup shaped resilient sealing element for covering the cooling water inlet opening, said sealing element including a water passage for supplying water to said water inlet and (B) a unitary mounting bracket formed from a single strip of sheet metal and attached to said resilient sealing element for holding said resilient sealing element compressed against said bottom surface, said mounting bracket including two projections on opposite ends of said strip for engaging an upper surface of said planar element on opposite sides, said mounting bracket including projections for extending into the region normally occupied by a propeller mounted on said propeller shaft.

2. The device defined in claim 1 wherein a hole is provided through said strip for attaching said resilient sealing element to said mounting bracket.

3. The device defined in claim 2 wherein said mounting bracket includes a portion generally positioned below said planar element of said outboard motor.

4. The device defined in claim 2 wherein said resilient sealing element includes a central cylindrical portion extending through said hole in said mounting bracket for attachment to said mounting bracket.

5. The device defined in claim 4 wherein said water passage extends through said central cylindrical portion of said resilient sealing element.

* * * * *